US005607084A

United States Patent [19]

George

[11] Patent Number: 5,607,084

[45] Date of Patent: Mar. 4, 1997

[54] LOCKING SYSTEM FOR BEVERAGE TAPS

[76] Inventor: David L. George, 300 S. 24th St., San Jose, Calif. 95116

[21] Appl. No.: 330,578

[22] Filed: Oct. 28, 1994

[51] Int. Cl.[6] ..... B67D 5/33

[52] U.S. Cl. ..... 222/153.03; 137/383; 222/153.14; 222/400.7; 222/509

[58] Field of Search ..... 222/146.6, 153.01, 222/153.03, 153.14, 399, 400.7, 400.8, 509; 137/383, 385

[56] References Cited

U.S. PATENT DOCUMENTS

| | | | |
|---|---|---|---|
| 753,349 | 3/1904 | Bacon | 137/385 X |
| 1,377,668 | 5/1921 | Cates et al. | 137/385 |
| 4,111,243 | 9/1978 | Fetterman | 141/102 |
| 4,271,992 | 6/1981 | Becker | 222/509 |
| 4,493,443 | 1/1985 | Bailey | 222/400.8 |
| 4,709,720 | 12/1987 | Russo | 137/385 |
| 4,911,333 | 3/1990 | Wilson | 222/153.14 |
| 5,145,096 | 9/1992 | Stenger | 222/400.8 |
| 5,287,874 | 2/1994 | Dixon et al. | 137/1 |
| 5,394,715 | 3/1995 | Guerette | 137/383 X |

FOREIGN PATENT DOCUMENTS

| | | | |
|---|---|---|---|
| 2246417 | 1/1992 | United Kingdom | 137/383 |

*Primary Examiner*—Joseph Kaufman
*Attorney, Agent, or Firm*—Michael J. Hughes

[57] ABSTRACT

A locking system for beverage taps (10) is provided for use with conventional beverage faucets (12) such as those utilized to dispense kegged beer and the like. The system (10) incorporates an elongated valve stem (14) which protrudes from the proximal end (38) of the faucet body (12) and is provided with an axial end bore (66) having pin threads (68) therein. A lock subassembly (18) actuated by a key (20) attaches to the valve stem (14) by a threaded driver pin (118) which engages the pin threads (66). A case cylinder (80) encloses the engagement position and overlaps a portion of the faucet body (12) such that antirotation ears (113) prevent relative rotation and loosening of the engagement except when the key (20) is utilized. When tightened, the lock subassembly (18) forces the valve stem (14) into a closed position, preventing opening of the faucet and dispensing of beverages.

17 Claims, 4 Drawing Sheets

LOCKING SYSTEM FOR BEVERAGE TAPS

TECHNICAL FIELD

The present invention relates generally to liquid dispensing apparatus and security devices, and more particularly to devices adapted to prevent unauthorized dispensing of beverages from bar faucets and taps.

BACKGROUND ART

One of the most efficient methods of dispensing beverages such as beer, wine and soft drinks, is by use of pressurized kegs and barrels or gravity fed lines connected to beverage faucets, usually known as "taps" (although this term should technically only apply to a dispensing device directly connected to the keg or barrel. The tap dispensing method yields what is often called true "draft" beer and ale and is generally regarded as being the best method of achieving optimal flavor and "head" on beer. The use of large quantity kegs and barrels makes the method efficient in terms of shipping, storage and connection/opening labor considerations. This makes it extremely popular in all ranges of commercial establishments, especially bars, hotels, arenas and pavilions.

A wide variety of faucet types have been used, with the purposes of providing even and leakproof dispensing and visually and ergonomically pleasing designs. In addition to well-known commercial faucet structures, such as those from The Superior Products Company of Chicago, Ill., and from the Perlick Company, Inc. of Milwaukee, Wis., various such have been the subject of U.S. Patents. Some patented beverage faucets and taps are described in U.S. Pat. Nos. 5,145,096, 4,493,443 and 4,271,992, issued to Stenger, Bailey and Becker, respectively. Most facilities utilize the hoary and well-proven conventional designs, however. Moreover, these are somewhat standardized, so interchangeability of various components is feasible.

Since taps are often in exposed areas, a problem can exist from persons drawing an unnoticed glass while the facility is unattended. Unauthorized employee dispensation is also relatively common. For these reasons, and others, operators desire methods of restricting access to the beverage taps except under normal operational conditions. Various methods and apparatus have accordingly been created and adapted to provide this type of security.

The most common form of security measure utilized with respect to beverage faucets is know as a "bail lock." This structure, primarily manufactured and distributed by the Perlick Company, includes a bracket which tightens over the faucet and handle and may be locked in position, once tightened. The device prevents the handle from moving and thereby opening the valve to dispense beverage.

Another method which has been commercially utilized, with some success, is to provide an extended valve stem with a vertical hole for receiving a padlock. The padlock nominally prevents movement of the valve stem and handle and inhibits dispensation. An inherent problem involves getting a tight enough fit to prevent leakage while avoiding damage to the seal rings, and permitting easy installation and removal. Further, like the bail lock, this type of approach involves a separate item which must be stored when normal usage is desired.

Another, more complex security device, which also serves other purposes, is described in U.S. Pat. No. 4,111,243, issued to Fetterman. This device also controls the handle in order to prevent dispensation. Another patent addressing a related problem with water faucets, and utilizing a simple structure to prevent handle access, is shown in U.S. Pat. No. 5,287,874 issued to Dixon, et al.

Each of the prior art security attempts is subject to objection in one means or another. Some which depend on restricting a long-lever-arm handle from motion by restriction near the fulcrum can have leakage since it is difficult to completely restrict motion in this manner. Multiple component structure, where the components are removed during normal usage can also be unwieldy to operate, since storage of the components may be troublesome. Some are complex so that they significantly interfere with conventional operation, when such is desirable. Additionally, it is usually not desirable for the security measures to be so visually blatant that attention is called to them.

Because of all of the problems associated with beverage faucets and security measures adapted for use therewith, a substantial need still exists for simple, inexpensive, secure, leakproof and aesthetically pleasing security systems.

SUMMARY OF THE INVENTION

Accordingly, it is an object of the present invention to provide a system for preventing unauthorized dispensation of beverages from tap apparatus with a minimal disruption of legitimate usage.

It is another object of the invention to provide a system which is adapted for use with a most existing faucet systems in an easily retrofit manner.

It is a further object to provide a locking system which effectively prevents fluid leakage and air contamination of beverages in the line adjacent to the faucet.

It is yet another object of the invention to match the user's needs as to common or specific key controls and to further provide easily discernible coding to differentiate among differently keyed systems.

It is still another object of the invention to provide a beverage faucet security system which may remain in place during normal tap usage without significantly interfering with operation.

It is a still further object of the invention to be aesthetically attractive and to cause the appearance and operation of the beverage faucet to be only slightly different after installation from before.

Briefly, a preferred embodiment of the present invention is locking system adapted to prevent unauthorized dispensing of beverages from faucets or taps such as those typically used in commercial establishments. The locking system includes a typical conventional faucet (tap) body, a unique valve stem, a conventional handle, and a lock subassembly for mounting on the faucet body and interfacing with the valve stem to prevent the valve from being opened and fluids from being dispensed except when the lock subassembly;in actuated by a key. Rotation of the key within the lock mechanism secures the lock case cylinder to the faucet body and also tightens the valve against the valve seat within the faucet body to completely cut off fluid flow.

The system is adapted to operate in an easily retrofit manner with most conventional beverage faucet designs, as well as in the form of a complete replacement or original installation unit. The lock mechanisms can be keyed to a single key for an entire facility or separately keyed according to the needs of the user. The lock case cylinder provides a visible surface for display of instructions, color coding or other user information, while only protruding a short distance beyond the original faucet body so as to avoid unnecessary interference with normal operation.

An advantage of the present invention is that beverage dispensing faucets may be simply and easily secured, such that unauthorized dispensation is prevented.

Another advantage of the invention is that the system may be readily installed in existing facilities with a minimum of disruption.

Yet another advantage of the invention is that the locking system only slightly alters the appearance and dimensions of the beverage tap apparatus upon installation, thus providing minimal interference with normal operation.

A further advantage of the present invention is that, once unlocked by the security personnel, the operation of the beverage tap is identical to the operation where no lock is installed.

Yet another advantage of the invention is that it need not be removed and separately stored in order to permit normal operation.

A still further advantage of the locking system of the present invention is that the direct interface with the valve stem applies closing force directly to the washer and valve seat, as opposed to indirect lever arm force translation which can permit mechanical shifting and consequent leakage.

Yet another advantage of the inventive system is that the operation results in automatic compensation for faucet wear.

Still another advantage of the invention is that it is easily removed for cleaning, replacement or repair.

A still further advantage of the system is that the lock case cylinder provides a useful display surface.

Another advantage of the faucet locking system is that multiple independent installations may be commonly keyed for rapid locking and unlocking by authorized personnel.

These and other objects and advantages of the present invention will become clear to those skilled in the art in view of the description of the best presently known mode of carrying out the invention and the industrial applicability of the preferred embodiment as described herein and as illustrated in the several figures of the drawings.

BEST MODE FOR CARRYING OUT THE INVENTION

Figure 1:
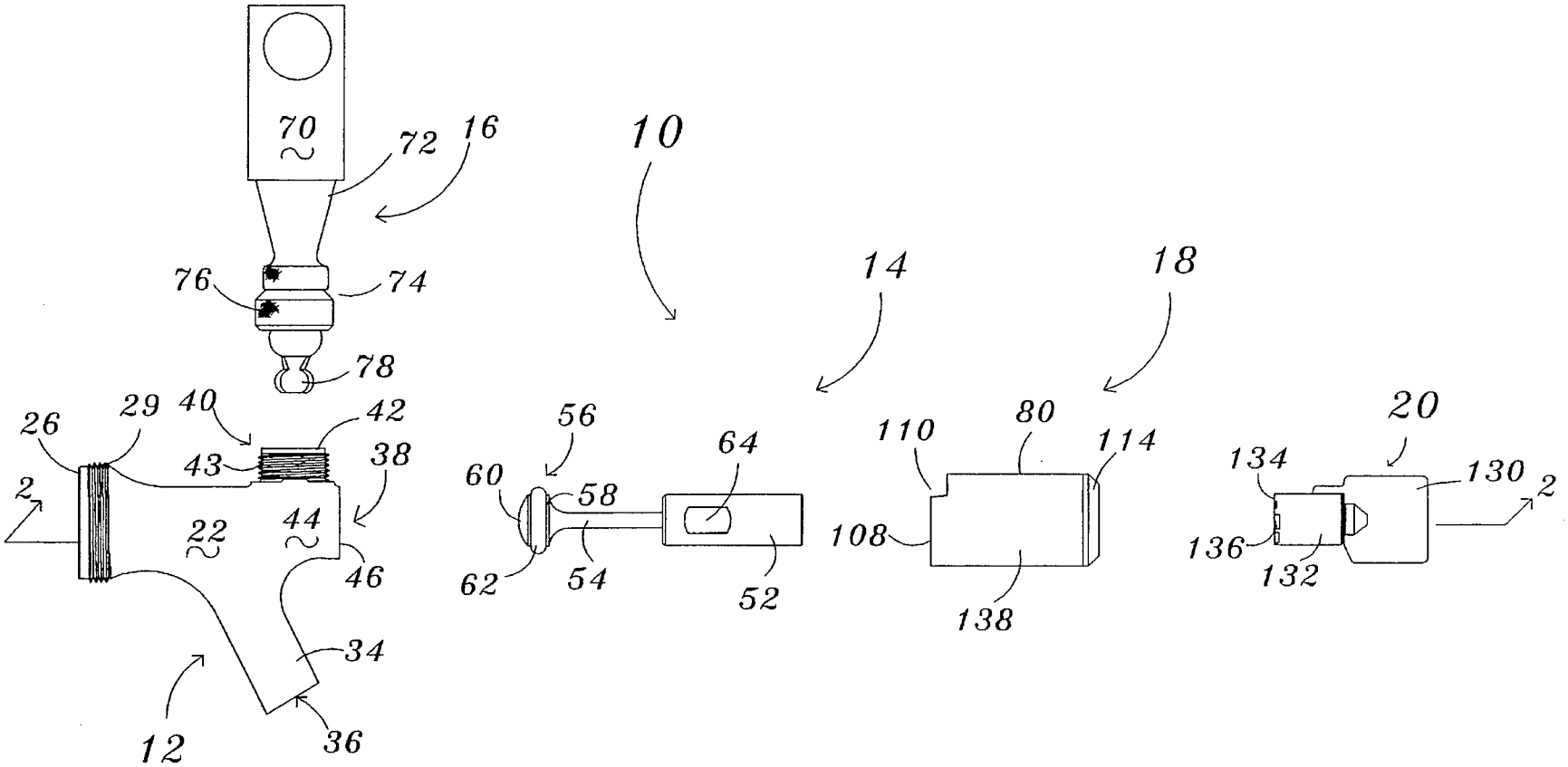
FIG. 1 is an exploded side elevational view of a beverage faucet (tap) adapted for a locking system according to a preferred embodiment of the present invention.

The preferred embodiment of the present invention is a locking system for beverage taps (faucets) adapted to secure the faucet in a leakproof mode in which unauthorized dispensation is effectively prevented. The locking system for beverage taps of the preferred embodiment is illustrated in an exploded side elevational view in FIG. 1 and is designated therein by the general reference character 10.

As illustrated in the various figures of the drawings, and particularly in the exploded view of FIG. 1, the locking system 10 includes several separately described components. These include a tap body 12, also referred to more correctly, but less commonly in the industry, as a faucet body 12, a valve stem 14 (rotated from actual), a handle 16, a lock subassembly 18 and a key 20. These major components have subparts of importance to the invention and will each be described hereinafter.

Figure 2:
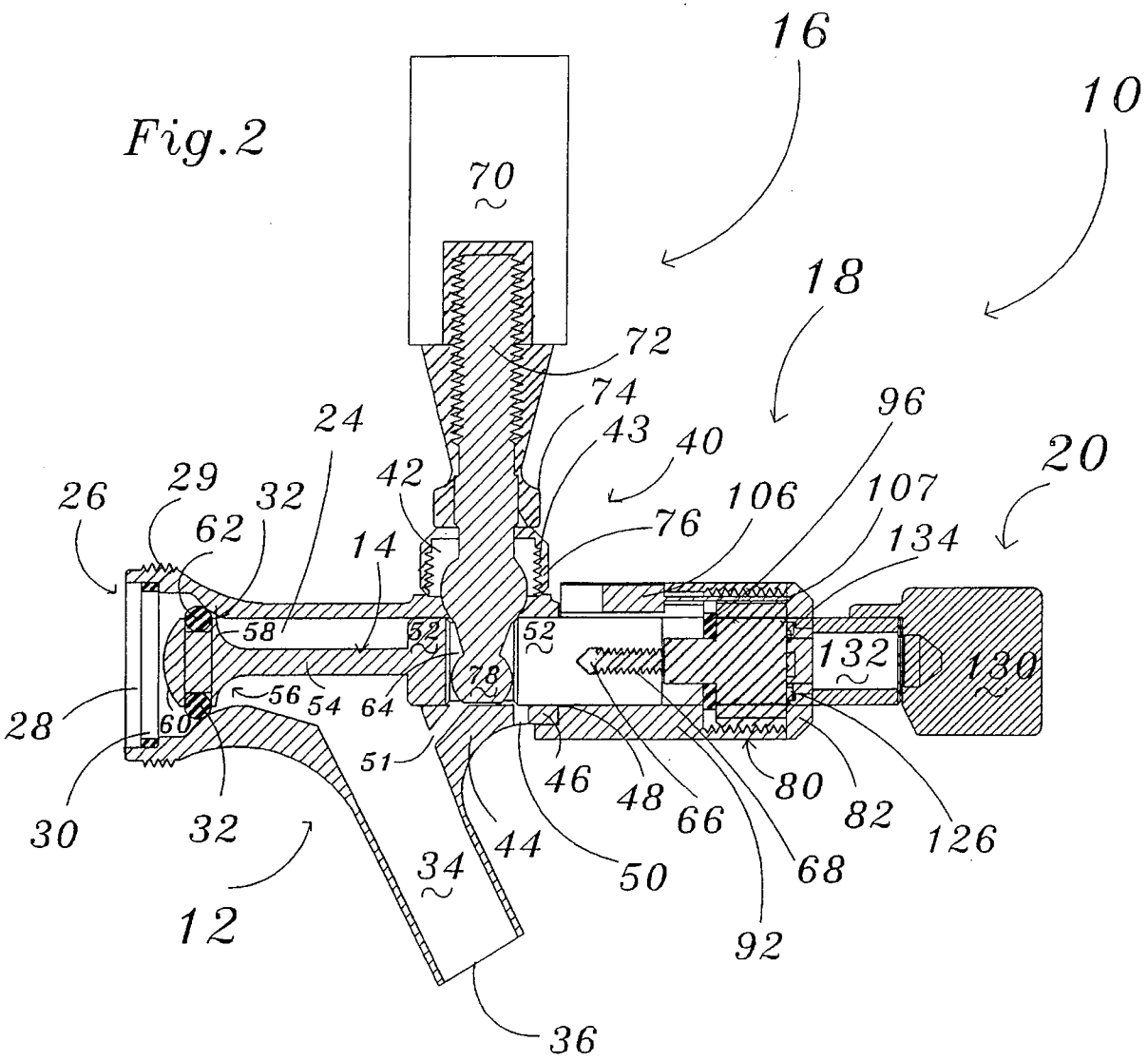
FIG. 2 is a cross sectional view, taken along line 2—2 of FIG. 1, shown assembled, rather than exploded.

Referring now especially to the exploded side view of FIG. 1 and to the assembled cross sectional view of FIG. 2, the faucet body 12 is seen to include a hollow barrel portion 22 including a bore 24 extending axially therethrough from a distal end 26 having an inlet port 28 whereby the body 12 is connected to the source of the beverage, such as a keg of beer or a tube connected to a wine barrel or soft drink source. The distal end 26 is that portion of the tap body 12 which is typically situated against a wall or vertical panel and may be thought of as the "rear" of the structure. The portion of the body 12 about the inlet port 28 is provided with thread, referred to herein as "keg" threads 29, in order to distinguish from other thread components discussed hereinafter. The interior of the inlet port portion 28 is provided with a washer 30. These components provide a leakproof seal on the connection to the beverage source.

Located within the bore 24 and displaced inward from the distal end 26 is a valve seat 32 in the form of a narrow portion of the interior of the hollow barrel body 22. The valve seat 32 provides a location against which the valve stem 16 abuts to open and close the faucet.

Depending from the central portion of the hollow barrel portion 22 is a spout portion 34 or spigot 34. This hollow structure provides an outlet 36 through which the dispensed beverages flow to the pitcher, glass or other receptacle. For empirical reasons, primarily air flow and turbulence control, the spigot 34 is set at an angle which is not perpendicular with respect to the axis of the bore (which axis is preferably arrayed to be horizontal), so the dispensing flow is not directly vertical.

Situated forward of the spigot portion 34 is a proximal end 38 of the tap body 12. The proximal end 38 will ordinarily be the "from" of the structure and will protrude the greatest degree from the wall or panel. The top surface of the proximal end 38 includes a handle port 40 at which the handle 16 is connected to the tap body 12 by insertion into a lever bonnet 42 and securing to handle threads 43 formed about the lever bonnet 42.

A proximal extension 44 lies forward of the handle port 40 and the spigot portion 36. The front end of the proximal extension is a flat surface which is referred to herein as a shield surface 46, because of the general shape in the structure of the preferred embodiment 10. The bore 24 extends all of the way through the tap body 12, as a consequence of the formation and milling processes, and terminates in a valve stem port 48 at the shield surface 46. A small bleeder aperture 50 is formed in the proximal extension 44 in order to permit air flow from the outside environment into to hollow barrel portion 22. An internal bleeder passage 51 is also formed in the body 12 in order to permit air flow between the spigot portion 34 and the bore 24 in the proximal end 38. The bleeder port 50 and bleeder passage 51 are provided such that pneumatic pressure does not inhibit free flow of the fluids.

The structure of the valve stem 14 is also best seen from FIGS. 1 and 2, with the valve stem 14 having been rotated about its major axis ninety degrees in FIG. 1 for ease of understanding and having been returned to the actual usable orientation in FIG. 2. The valve stem 14 includes a stem cylinder portion 52 from which a stem post 54 protrudes. The stem post 54 continues until it thickens to form a washer retainer 56 including an interior retainer ridge 58 and an exterior nub 60 which secure an O-ring type washer 62 in position. The 0-ring washer 62 is adapted to abut against the valve seat 32 to form a fluid seal if axial pressure is applied. Since the diameter of the O-ring washer 62 is greater than the interior diameter of the bore 24, the washer retainer 56 portion of valve stem 14 is unable to pass the valve seat 32, so the valve stem 14 must be inserted into the bore 24 from the distal end 26. The abutment against the valve seat 32 further defines the amount by which the stem cylinder 52 protrudes through the valve stem port 48 to extend beyond the shield surface 46.

The stem cylinder 52 is provided with several features, some conventional and some unique to the present invention 10. One of the most notable differences is that the stem cylinder 52 is somewhat elongated in comparison to most conventional valve stems such that it extends approximately 1.25 cm (½ in.) beyond the shield surface 46 when the valve is completely closed. This additional length facilitates attachment of the lock subassembly 18. The diameter of the stem cylinder is very slightly less than that of the bore 24 so that the valve stem 14 slides smoothly therein, is maintained on the axis of the bore 24 so that a good seal is created when the 0-ring washer 62 is pulled against the valve seat 32, and is closely enough held against the bore 24 so that fluid leakage is inhibited, but some air flow is permitted.

A conventional lever channel 64 (see FIG. 1, especially) extends diametrically through the stem cylinder 52 and provides the operant interface with the handle 16. An end bore 66 is provided with pin threads 68 at the proximal end of the stem cylinder 52 to provide the operant interface with the lock subassembly 18.

The component parts and operation of the handle 16 are illustrated in FIGS. 1 and 2, with particular attention to FIG. 2. The handle 16 may be seen to include a hand grip 70 (often adorned with a logo or indentifying information) which screws onto a handle lever 72. The handle lever 72 extends through a swivel joint 74 which is pivotally connected to a threaded connector 76, to terminate in a lever protrusion 78. When the handle 16 is installed, see FIG. 2, the threaded connector 76 is secured to the handle threads 43 on the lever bonnet 42 and the lever protrusion 78 extends into the bore and into the lever channel 64 in the stem cylinder 52. The end of the lever protrusion 78 is curved such that it maintains tangential contact with the interior ends of the lever channel 64, regardless of angular orientation. The swivel joint 74 theoretically allows swiveling completely about a vertical axis, but the interface of the lever protrusion 78 and the lever channel 64 effectively prevents swiveling except in a plane containing the axis of the bore 24.

Figure 3:
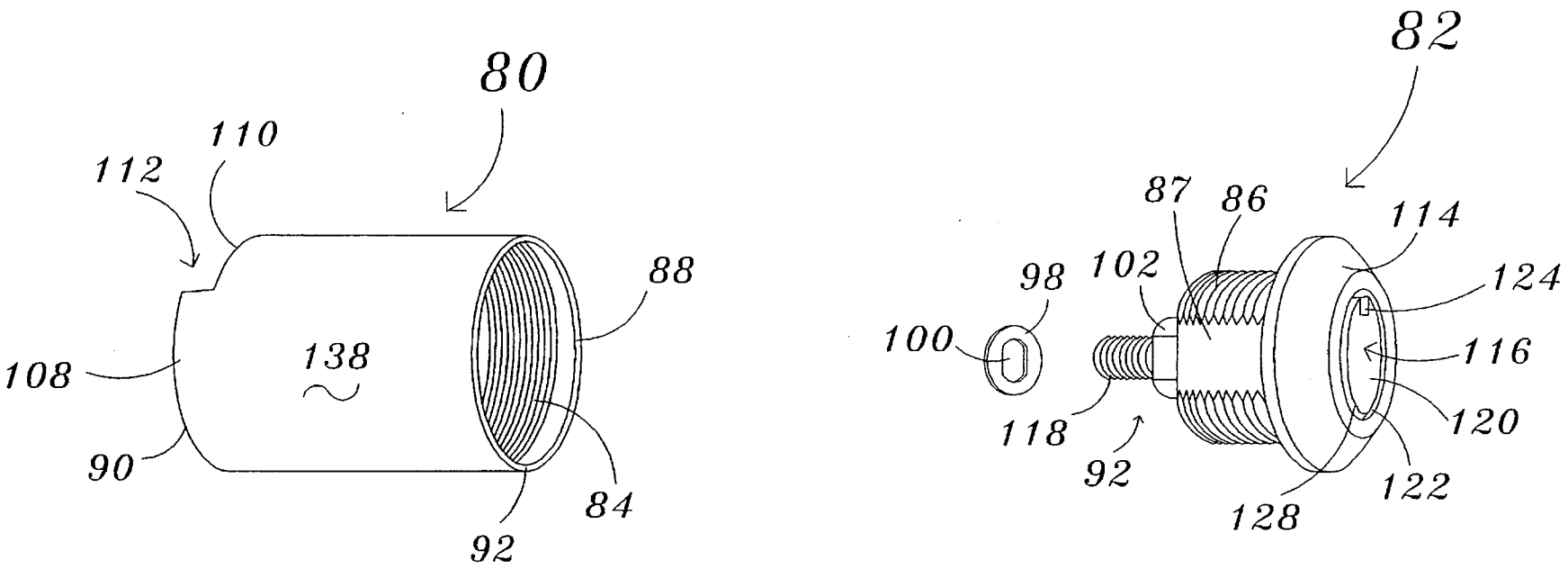
FIG. 3 is an exploded perspective view of the lock subassembly portion of the invention.
Figure 4:
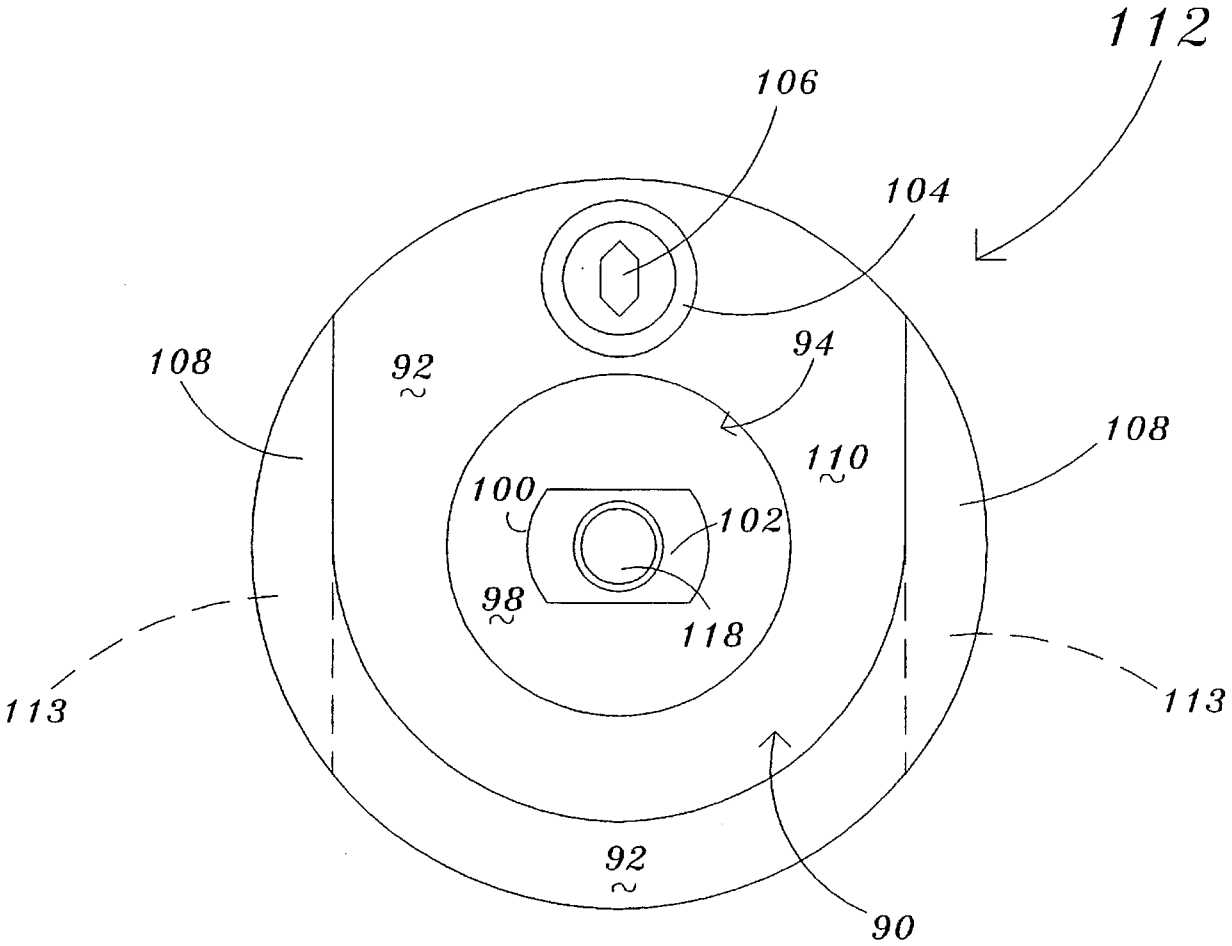
FIG. 4 is a distal end elevational view of the lock subassembly.

The various aspects of the lock subassembly 18 are best seen in the views of FIGS. 2, 3 and 4. The lock subassembly 18 is an optional portion of the faucet structure, that is, the faucet will work properly if the lock subassembly 18 is removed entirely, but is a major part of the invention 10 since it is what provides the security to the system. The lock subassembly 18 primarily includes a case cylinder 80 and a key cylinder 82, which are joined together to form an integral unit for operational purposes. Case threads 84 formed in the interior surface of the case cylinder 80 and cylinder threads 86 formed on the key cylinder 82 provide the means for attachment. The portion of the key cylinder 82 containing the cylinder threads 86 also includes opposing flat panels 87 which serve a variety of manufacturing and security purposes.

The case cylinder 80 has a proximal case end 88 which engages the key cylinder 82 and a distal case end 90 adapted to be installed on the valve stem cylinder 52. The case cylinder 82 is a single extruded and milled component having a case wall 92 which is relatively thin near the proximal case end 88, to receive the key cylinder thread 86 portion, while the case wall 92 is thicker in the center and at the distal case end 90, defining an interior central cavity 94. A shoulder 96 is formed in the interior of the case cylinder 80 at the proximal end of the central cavity 94.

A thrust washer 98 is inserted intermediate the key cylinder 82 and the case cylinder 80. The thrust washer 98 has a diameter slightly greater than that of the central cavity 94 so the thrust washer 98 abuts against the shoulder 96. The thrust washer 98 is further provided with a "Double D" aperture 100 which surrounds a "Double D" post 102 which extends from the key cylinder 82 into the central cavity 94. The interface between the Double D aperture 100 on the thrust washer 98 and the corresponding post 96 provides axial load reduction by preventing the key cylinder from being held too tightly against the shoulder 96 and by providing a partially held element to keep the operant portion of the key cylinder 82 from spinning easily with respect to the faucet 12. This helps provide antirotation security aiding in preventing the key cylinder 82 from rotating as a whole with respect to the case cylinder 80, once installed, except when activated by the key 20.

Further antirotation security is also provided within the lock subassembly 18, as well as in the assembled security system 10. As shown particularly in the end view of FIG. 4, the central cavity 94 is structured so as to receive the stem cylinder 52 therein. The case wall 92, at what is defined to be the "top" is further provided with an inset bore 104 extending longitudinally therethrough all the way from the distal case end 90 to the proximal case end 88. An inset securing screw 106 is placed within the inset bore 104 to interface with inset screw threads 107 formed in the key cylinder 82. The inset securing screw provides a means of securing the fixing the relative rotational positions of the case cylinder 80 and the key cylinder 82 in a tamper proof manner, since the inset securing screw 106 is inaccessible when the lock subassembly 18 is installed on the faucet body 12, as shown in FIG. 2.

Antirotation means adapted to prevent undesired rotation of the lock subassembly 18 with respect to the faucet body 12 is provided by a positioning ridge 108 formed at the distal case end 90. The positioning ridge 108 surrounds a depression 110 formed on the distal case end 90 and has a top opening 112. The positioning ridge 108 is "U" shaped such that it matches that of the exterior edges of the shield surface 46 of the preferred faucet body 12. The depth of the depression 110 from the distal case end 98 is such that, when installed, the positioning ridge 108 overlaps the proximal extension 44 to a sufficient degree that the shield surface 48 abuts against the surface of the depression 110 and the positioning ridge 108 prevents any rotation of the lock subassembly 18 with respect to the tap body 12. It is noted that not all commercially popular faucets have asymmetrically shaped proximal extensions with shield surfaces and that some are completely cylindrical, thus providing no inherent purchase for the positioning ridge 108 to prevent rotation. For this reason the depth of the depression 110 is sufficient that, on such faucets, the top opening 110 will surround, and the positioning ridge 108 will actually abut against, the sides of the lever bonnet 42, thereby preventing rotation.

A variant of the design is shown by the dotted lines of FIG. 4. In this variant, the bottom portion of the U-shaped positioning ridge 108 is removed and only a pair of opposed antirotation ears 113 remain. The depth of the depression 110 is then increased so that the antirotation ears 113 overlap the faucet body 12 to a greater degree than is shown in FIG. 2 (the removal of the bottom curve portion of the positioning ridge 108 is necessary to allow this overlap). This variant allows a greater degree of axial sliding of the lock subassembly 18 with respect to the faucet body 12 and a greater range of axial motion of the valve stem 14 with the lock subassembly 18 installed.

The key cylinder 82 is substantially conventional in design and is a standard commercially available structure. With the exception of adding the Double "D" post 102 and the inset screw threads 107, discussed above, little modification is required. However, to aid in understanding the invention, the mechanisms of the key cylinder 82, as best illustrated in FIGS. 2 and 3, will be set forth.

The portion of the key cylinder 82 which is stationary with respect to the case cylinder 80 includes a collar 114, the cylinder thread 86 portion and the Double D post 102. The inset screw threads 107 are located at the top of the distal side of the collar 114. The collar is affixed to the case cylinder 80 in a nonrotational fashion by screwing the cylinder threads 86 into the case threads, with the Double D post 102 extending through the Double D aperture 100 until the thrust washer 98 abuts against both the key clyinder 82 and the shoulder 96, with one of the flat panels 87 to the top, to provide clearance for the inset securing screw 106. The inset securing screw 106 is then secured to the inset screw threads 107. Optionally, additional affixing may be provided by adhesive.

The portion of the key cylinder 82 which rotates includes a driver 116 which is mounted axially within the collar 114. The driver 116 extends from a threaded driver pin 118 extending through the Double D post 102 to within the central cavity 94 to a driver face 120 which is flush with the face of the collar 114. The threaded driver pin 118 is adapted to screw into the pin threads 68 in the end bore 66 of the valve stem 14 when the lock subassembly 18 is mounted.

The interface between the collar 114 and the driver 116, in the vicinity of the driver face 120 forms a key hole 122 adapted to receive the key 20. The driver face 120 includes a single tang notch 124 in the preferred embodiment 10 illustrated, although additional tang notches at different radial positions may also be provided. Since no particular rotational position of the driver 116 is crucial in the operation of the preferred embodiment 10, there is no need for a corresponding tang notch in the collar 114 to define such a rotational alignment. Within the key hole 122, a plurality of tumbler pins 126 are arrayed about a rotation ring 128. The tumbler pins 126 are axially spring loaded.

The key 20 is adapted to operate the driver 116. The key 20 includes a key handle 130 by which it may be gripped and a customized key extension 132 affixed to the key handle 130. The key extension 132 is in the form of a hollow cylinder provided on its interior surface with a tang 134 for mating with the tang notch 124 in the driver 116 (or a plurality of tangs adapted to mate with the plurality of tang notches in alternate driver faces). The outside edge of the key extension 132 includes tumbler notches 136 which are of varying radial positions and depths so as to mate with the tumbler pins 126 within the keyhole 122. This conventional arrangement permits the driver 116 to be rotated with respect to the collar 114 only by the proper key 20.

A final aspect of the invention which has utility in the large operations, particularly, is that the case cylinder 80 has a circumferential label surface 138 available for display of information. In the preferred embodiment 10, the label surface 138 supports instructional labels explaining the usage of the system. One useful adaptation is to provide colored labels which may be coded to such criteria as the nature of the beverage being dispensed, or, more particularly, to the particular variety of key 20 which operates with the lock subassembly 18 installed. In this manner, the user, particularly a user with a large plurality of beverage taps, such as an arena concessionaire, can utilize multiple locking systems 10 with several being keyed to each of a variety of keys 20. The keys 20 can be coded similarly so the operator can selectively control security on different types of taps.

In the preferred embodiment 10, when delivered as a new, rather than retrofit, unit, the preferred faucet body 12 and handle 16 are those designated as part number 4933 by the Superior Products Company. The valve stem 14 is a modified variant of part number 4322LA from the same source. The preferred material for these components is stainless steel. In a retrofit situation, the existing faucet and handle are utilized and only the valve stem 14 is replaced.

The case cylinder 80 is a custom manufactured structure and is preferably formed of extruded aluminum. The preferred case cylinder 80 has a diameter of 2.25 cm (0.875 in) and a length of 3.25 cm (1.25 in), with the depression 110 having a depth of 0.35 cm (0.125 in) and the central cavity having a diameter of 1.1 cm (0.45 in).

The preferred key cylinder 82 and key 20 are obtained from the Fort Lock Company of Chicago, Ill. and are substantially conventional vending machine cylinder lock structures. The materials are die cast zinc and brass, with portions being stainless steel. These items are sold as matched sets, with multiple key cylinders 82 keyed to the same key 20 being available for uses as described above.

Although the end bore 66 provided with pin threads 68 to mate with the threaded driver pin 118 is the much preferred method of attaching the lock subassembly 18 to the faucet 12 and valve stem 14, other methods may also be envisioned, so long as they provide adjustable axial force to the valve stem 14 The round shape of the case cylinder is a matter of design choice only, to match the conventional key cylinder 82, and is not critical to function.

Although, the preferred embodiment 10 is shown with a key actuated lock mechanism, it is also envisioned that other types may also be feasible. Modified combination lock structures could be-incorporated which result in turning the threaded driver pin 118 only when the proper combination has been completed and other conventional lock types might also be appropriate. The present structure is desirable because the force of turning the key 20 is the rotational force required to operate the threaded driver pin 118, as well.

It would also appear, upon initial inspection, that conventional, rather than elongated valve stem members 14 might be used, since the required external overlap with the lock subassembly 18 is minimal, or nonexistent. However, it is necessary that there be an available length of stem cylinder 52 for the end bore 66 to provide some range of axial engagement. Shorter valve stems do not have this available length, since the lever channel 64 would be situated too close to the end. Further, since the system 10 operates by translating the rotational motion of the threaded driver pin 118 to axial motion of the valve stem 14 (via the screw engagement, it is necessary that the valve stem 14 be prevented from rotation. In the application illustrated, this limitation is inherent since the engagement of the lever protrusion 78 with the lever channel 64 completely prevents any rotation of the valve stem 14. However, in other potential applications, such as are envisioned for any type of device in which controlled axial positioning needs to be secured, care must be taken to prevent undesired rotation of the axial member, if the system is to properly function.

In addition to the above mentioned examples, various other modifications and alterations of the dimensions, materials, shapes and precise structures of the components may be made without departing from the invention. Accordingly, the above disclosure is not to be considered as limiting and the appended claims are to be interpreted as encompassing the entire spirit and scope of the invention.

INDUSTRIAL APPLICABILITY

The locking system for beverage taps 10 according to the present invention is adapted for use with popular beverage faucets (taps) used for dispensing kegged or barreled beverages such as beer, wine, juices and some soft drinks. It will provide security, controllable by authorized personnel having the appropriate keys, and is especially useful for taps which are in exposed locations where persons might have access to the taps themselves at times when beverage dispensing is not desirable. This is especially the case with facilities such as bars hotels and arenas with multiple taps in various locations.

Converting an existing faucet for use with the system is easily accomplished by detaching the faucet 12, removing the existing valve stem and inserting the modified valve stem 14 of the invention (this will also require removing and reinserting the handle 16), and then reattaching the faucet 12.

Installation of a locking beverage tap system 10 onto a prepared faucet 12 is also a simple matter. With the handle 16 pivoted so the faucet is in the closed position, the distal case end 90 of the case cylinder 80 is placed over the protruding end of the stem cylinder 52, with the stem cylinder 52 being inserted into the central cavity 94. The entire lock subassembly 18 may then be rotated to start the threaded driver pin 118 into the pin threads 68 to engage the components together. The rotation can be continued until the proximal extension 44 interferes. Then the key 20 is inserted into the keyhole 122 and only the driver 116 will be rotated, so that the axial connection may be tightened without turning the case cylinder 80.

To fully lock the system 10, the key is turned until the shield surface 46 is held flush against the depression 110 and the valve stem 14 is firmly held in the closed position by the axial pressure applied by the driver 116. When the key 20 is removed, the lock subassembly 18 is prevented from rotating as a unit by the interaction of the positioning ridge 108 (or antirotation ears 113) with the proximal extension 44 (or in the case of round end faucets, by the edges of the top opening 112 with the lever bonnet 42). Without the key 20, the driver cannot turn independently of the case cylinder 80, so it is not possible to loosen the lock (it has been found that only destructive force to the handle 16 can be sufficient to open the valve when the lock subassembly 18 is installed and tightened).

When it is desired to operate the tap, as during normal business operations, the key 20 is inserted and the reverse rotation is continued until, with the handle 16 in the closed position, the positioning ridge 108 slightly overlaps the proximal extension 44. With the preferred faucet body 12, this means that the case cylinder 80 is still prevented from rotation, but does have some axial freedom of movement. The depth of the depression 110 is sufficient that the axial freedom is sufficient to allow full opening of the valve and dispensation of the beverages, without removing the lock subassembly 18. Since the case cylinder 80 cannot be rotated, this means that it is not possible in this orientation to remove the lock subassembly 18 from the faucet without further rotation using the key 20. Therefore, the lock subassembly 18 remains installed until removed by authorized personnel. Since it does not, in this orientation, interfere with normal operations, this is a decided benefit since it does not require separate storage and the lock up procedure is simply inserting the key 20 and tightening. This can continue indefinitely until disassembly becomes desirable, such as for cleaning of the faucet and components, at which time removal is easily accomplished.

For the above, and other, reasons, it is expected that the locking system for beverage taps 10 of the present invention will have widespread industrial applicability. The system 10 provides substantial advantages in that it is essentially leakproof, aesthetically pleasing, need not be removed for normal usage of the faucet and is simple and secure in installation and operation. It is also economical to manufacture and install and to retrofit on existing faucet structures. Therefore, it is expected that the commercial utility of the present invention will be extensive and long lasting.

What is claimed is:

1. A locking system for beverage taps, comprising:

faucet means for dispensing fluids, said faucet means including an axial bore therethrough for receiving a valve stem therein such that axial movement of the valve stem within the axial bore, intermediate an open position and a closed position controls dispensation of fluids through said faucet means, the valve stem protruding axially from said faucet means and including a stem cylinder portion at one end thereof, the stem cylinder portion being that portion which protrudes from the axial bore, the stem cylinder portion being provided with a threaded axial bore in the protruding end thereof; and lock subassembly means for engaging the valve stem and providing securable axial force thereto, the amount of axial force provided by said lock subassembly means at least being sufficient to securely hold the valve stem in the closed position when fully engaged, said lock subassembly including unlocking means for adjusting the amount of the axial force and for removing the lock subassembly means from the valve stem and a threaded pin in the interior thereof to engage the threaded axial bore, such that rotation of the threaded pin axially moves the valve stem with respect to said lock subassembly and provides the axial force thereon.

2. The locking system of claim 1, wherein the length of the threaded axial bore is sufficient to permit engagement of varying degree such that the valve stem may axially be moved from the closed position to at least a partially open position while engaged with the threaded pin.

3. The locking system of claim 1, wherein said lock assembly includes:

a rotationally stationary portion provided with antirotation means to prevent rotation thereof with respect to said faucet means, when said locking subassembly means is engaged thereon; and a rotatable driver portion, including the threaded pin, the rotatable driver portion being rotatable with respect to the rotationally stationary portion only in conjunction with the unlocking means.

4. The locking system of claim 1, wherein said lock subassembly is provided with a keyhole and the unlocking means is in the form of a key for engaging the keyhole.

5. The locking system of claim 1, wherein said lock subassembly includes antirotation means for engaging said faucet means such that, when engaged, said lock assembly is prevented from rotating with respect to said faucet means.

6. The locking system of claim 5, wherein said lock assembly includes a visible surface expanse for displaying information.

7. A security system kit for installation on a beverage tap, the beverage tap including an axial bore extending through a faucet body and having an aperture at a proximal end of the faucet body, and an axial-shaft type valve associated with the axial bore for controlling fluid dispensation therefrom, the kit comprising:

a valve stem for installation into the axial bore to form therewith the axial-shaft type valve, said valve stem including sealing means for engaging the faucet body to control the fluid dispensation, a stem cylinder for extending within the axial bore and a protruding end for extending outward from the proximal end of the faucet body, the protruding end including an axially disposed threaded bore;

lock subassembly means for engaging both said valve stem and the proximal end of the faucet body, said lock subassembly means including a case portion for engaging the proximal end so as to remain stationary with respect thereto when engaged, and a driver means for engaging said valve stem in a manner so as to cause controllable axial movement of said valve stem in response to movement of the driver portion, said movement extending at least to a position of said valve stem wherein fluid dispensation from the tap is prevented, the driver means including a threaded pin for axially engaging the axially disposed threaded bore of the stem cylinder portion; and locking driver activation means for causing movement of the driver means when a driver actuator is engaged therewith but preventing any movement of the driver means when the driver actuator is not so engaged.

8. The security system kit of claim 7, wherein the driver means is configured such that rotational motion applied to an end thereof is translated into axial motion of said valve stem.

9. The security system kit of claim 8, wherein the case portion includes antirotation protrusion means for engaging the faucet body and preventing the case portion from rotating with respect thereto.

10. The security system kit of claim 7, wherein the driver portion includes key activation shaping, and the driver actuator means includes a key adapted to mate with the key activation shaping.

11. The security system kit of claim 7, wherein the case portion is in the form of a case cylinder including a distal end portion having a positioning ridge extending therefrom to engage the faucet body and inhibit rotation with respect to the faucet body when engaged, the case portion also including a central cavity formed therein for receiving the protruding end of the stem cylinder;

the driver means includes a key cylinder, a collar portion of which is fixed to the case cylinder, and a driver portion which is free to rotate with respect to the case cylinder when engaged by the driver actuator, but is fixed with respect to the case cylinder when the driver is not engaged by the driver actuator.

12. The security system kit of claim 11, wherein an inset bore is provided in the case portion adapted to receive a securing screw therewithin, the securing screw engaging a set of inset screw threads in the collar portion to prevent rotation of the collar portion with respect to the case cylinder.

13. The security system kit of claim 11, wherein a thrust washer, rotationally affixed to the driver portion, is provided intermediate the case cylinder and a part of the collar portion so as to provide axial load reduction.

14. A lock assembly adapted to be utilized with an axially extending stem cylinder of a device which utilizes axial movement of the stem cylinder as a control mechanism, one extreme axial position of the stem cylinder being defined as a desired control position, and the extending end of the stem cylinder being provided with an axial threaded bore formed therein, the lock cylinder assembly comprising:

a case cylinder including a distal end with at least one antirotation projection extending therefrom, the antirotation protections being adapted to engage fixed structures associated with the device in order to prevent said case cylinder from rotating with respect to the device, said case cylinder further including a central cavity for receiving the extending end of the stem cylinder;

driver means extending within the central cavity and including a threaded pin to engage the axial threaded bore and keyed selective rotation means to prevent rotation of the threaded pin with respect to said case cylinder except when the keyed selective rotation means are unlocked by driver actuator means, said driver means being rotatable to such degree that the stem cylinder is axially driven by the rotation of the threaded pin in the axial threaded bore to at least the desired control position.

15. The lock assembly of claim 14, and further including a collar member affixed to said case cylinder and enclosing the driver means, the collar portion and driver means together forming a key cylinder.

16. The lock assembly of claim 15 wherein an exposed interface of the collar portion and the driver means forms a keyhole, with the keyed selective rotation means being in the form of at least one tang notch on the driver means and a plurality of tumbler pins within the keyhole for releasing rotation of the driver means with respect to the collar portion when corresponding tumbler notches on a key inserted into the keyhole match the tumbler pins.

17. The lock assembly of claim 14 wherein said case cylinder is formed of extruded aluminum.

* * * * *